US006954983B2

(12) United States Patent
Fröschl et al.

(10) Patent No.: US 6,954,983 B2
(45) Date of Patent: Oct. 18, 2005

(54) METHOD FOR PRODUCING FLAT CABLES

(75) Inventors: Karl Fröschl, Herrnbaumgarten (AT); Frank Bennerscheidt, Hennef (DE); Hartmut Halter, Troisdorf (DE)

(73) Assignee: Reifenhäuser GmbH & Co Maschinenfabrik, Troisdorf (DE)

( * ) Notice: Subject to any disclaimer, the term of this patent is extended or adjusted under 35 U.S.C. 154(b) by 120 days.

(21) Appl. No.: 10/432,067

(22) PCT Filed: Nov. 14, 2001

(86) PCT No.: PCT/EP01/13149

§ 371 (c)(1),
(2), (4) Date: May 19, 2003

(87) PCT Pub. No.: WO02/41327

PCT Pub. Date: May 23, 2002

(65) Prior Publication Data

US 2004/0029451 A1 Feb. 12, 2004

(30) Foreign Application Priority Data

Nov. 20, 2000 (DE) ..... 100 57 458
Jan. 25, 2001 (DE) ..... 101 03 367

(51) Int. Cl.[7] ..... H01R 43/00
(52) U.S. Cl. ..... 29/825; 29/856; 264/174.1; 264/280
(58) Field of Search ..... 29/825, 856; 264/174.1, 264/280

(56) References Cited

U.S. PATENT DOCUMENTS 3,523,844 A * 8/1970 Brakefield et al. ..... 156/52
3,802,974 A * 4/1974 Emmel ..... 156/55
3,833,443 A 9/1974 Naseth et al.
3,953,566 A * 4/1976 Gore ..... 264/505
4,311,002 A * 1/1982 Hoffmann et al. ..... 57/293
4,375,379 A * 3/1983 Luetzow ..... 156/52
4,663,098 A * 5/1987 Gilliam et al. ..... 264/104
5,235,132 A * 8/1993 Ainsworth et al. ..... 174/36
5,286,924 A * 2/1994 Loder et al. ..... 174/117 F
5,306,869 A * 4/1994 Springer et al. ..... 174/36
5,607,719 A * 3/1997 Winkler et al. ..... 427/117
5,917,154 A 6/1999 Mortier

FOREIGN PATENT DOCUMENTS

| | | |
|---|---|---|
| DE | 2 029 130 | 2/1973 |
| DE | 34 08 613 A1 | 9/1985 |
| DE | 42 00 311 A2 | 7/1993 |
| DE | 195 34 012 C2 | 7/1997 |
| EP | 0675 576 A1 | 10/1995 |
| EP | 0 066 740 B1 | 7/1996 |
| EP | 0 938 099 A1 | 8/1999 |
| FR | 2 446 532 | 8/1980 |
| WO | WO 87/06760 | 11/1987 |
| WO | WO 98/52199 | 11/1998 |

* cited by examiner

*Primary Examiner*—Carl J. Arbes
(74) *Attorney, Agent, or Firm*—Pauley Petersen & Erickson

(57) ABSTRACT

A method for continuously producing flat cables with electric conductors embedded in an isolating material which are arranged at a certain distance from each other, parallel to each other. According to this invention, the band shaped conductors are guided separately in a plane forming two sides of a surface. The surface sides have insulating layers based on thermoplastic synthetic materials. According to this invention, at least one of the insulating layers which covers the surface sides is produced by extrusion coating of a thermoplastic melt.

24 Claims, 5 Drawing Sheets

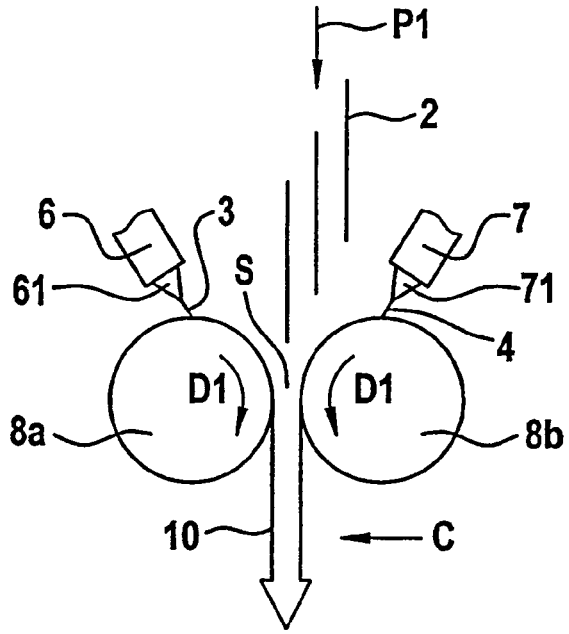
Fig. 1
Fig. 2
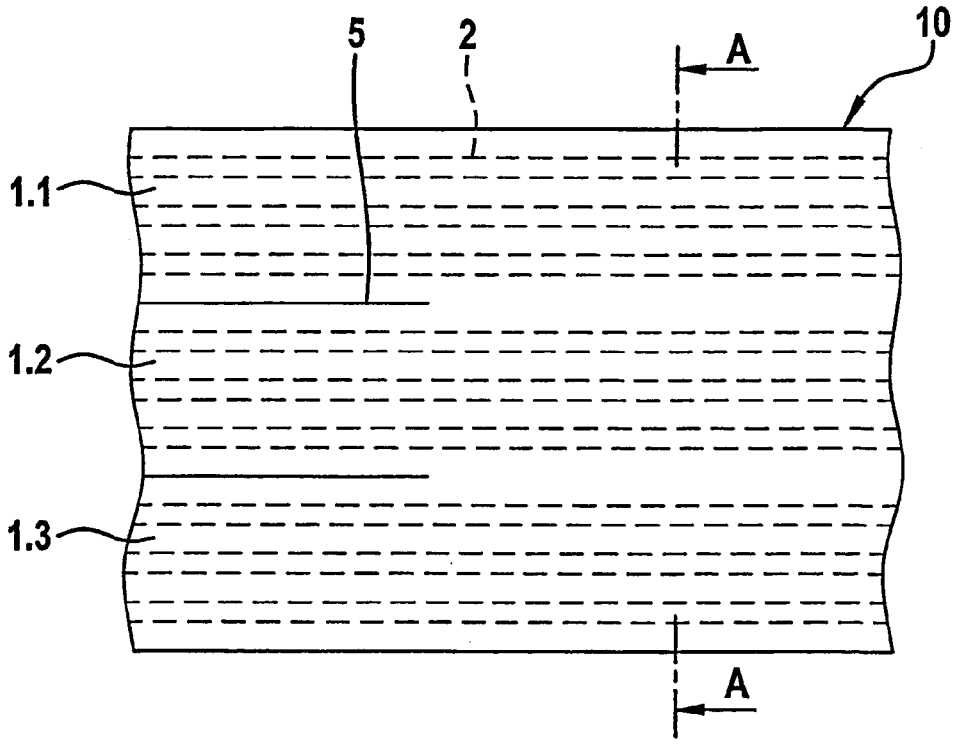
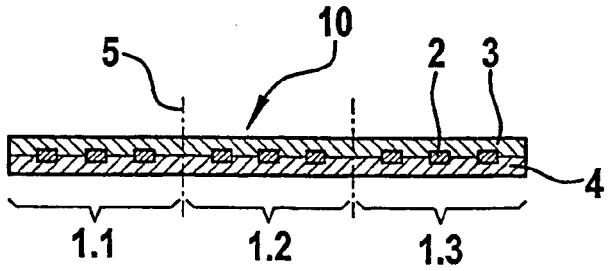
Fig. 3

METHOD FOR PRODUCING FLAT CABLES

BACKGROUND OF THE INVENTION

1. Field of the Invention

This invention relates to a method for the continuous production of ribbon cables with electrical conductors, which are arranged spaced apart from each other and parallel with respect to each other and are embedded in insulating material, wherein ribbon-shaped conductors are guided, spaced apart from each other, on one level, forming two surfaces, and the surfaces have insulating layers on the basis of thermoplastic materials, and the ribbon-shaped conductors are embedded between the insulating layers.

2. Discussion of Related Art

Ribbon cables are employed in great numbers in the electronic industry, computer industry and, for example, in connection with products where little space is available, such as in motor vehicles, or aircraft, for example. A conventional method is the production of ribbon cables by extrusion, wherein endless conductors are passed through a nozzle and are enclosed by the extruded molten plastic material. These ribbon cables are called flat extruded cables (FEC).

A further method is the production of ribbon cables by laminating them between two plastic films made of a thermally-stable thermoplastic material, wherein there is an adhesive layer between the two plastic films as the embedding layer, in which the conductors are embedded. These ribbon cables are also called flexible flat cables (FFC).

U.S. Pat. Nos. 5,917,154 and 3,833,443, PCT International Publications WO 87/06760 and WO 98/52199 and European Patent Reference EP 0 675 576, for example, in connection with teach the above explained prior art.

The ribbon cables must meet the requirements regarding temperature resistance, hydrolysis resistance, little shrinkage, easy processability, and simple production of contacts and connectors.

In connection with FFC ribbon cables, laminated with the use of an adhesive layer, the adhesive layer can be problematical, because it must be removed in the areas of contact points. The laminated films also have a tendency to become delaminated at high temperatures, such as can occur in the summer in the engine and the roof area of motor vehicles, for example.

With extruded FEC ribbon cables there is a tendency of the conductors to wander during production, so that inaccuracies in the cable guidance exist. Also, lower limits apply to the thickness of the extruded insulating layer, so that as a rule the FEC ribbon cables are thicker than the FFC ribbon cables produced by lamination.

SUMMARY OF THE INVENTION

One object of this invention is to provide an economical method for producing ribbon cables, which is operated at high production speeds and accurately, and wherein it is simultaneously possible to reduce the total thickness of the insulated layers in comparison with extruded cables. Another object of this invention is for producing ribbon cables of lesser thickness than extruded ribbon cables, which can be used without adhesive layers. It is a further object to produce ribbon cables so that no cleaning of the conductor ends which are to be exposed is necessary. A further object of this invention is to provide for the reduction of the shrinking tendency of ribbon cables produced by extrusion.

This object is achieved in accordance with this invention using a method for the continuous production of ribbon cables, wherein at least one of the insulating layers forming the surfaces is made of a molten thermoplastic material, which is produced by a flat film nozzle of an extruder and is immediately connected in the still plasticized state with the ribbon-shaped conductors and the other insulating layer under the application of pressure. In accordance with this invention, the extrusion coating method, which is known for the production of extruded layers, is for the first time used for the production of ribbon cables. The thermoplastic melt is extruded through a flat film nozzle/flat sheet die and the molten film exiting from the nozzle, which is normally of low viscosity, is drawn out by appropriate speed differences between the nozzle outlet and the surface of the roller/cooling roller, to which the molten film is applied, for example is reduced in thickness. In this way it is possible to produce ribbon cable films with insulating layers of less than 100 $\mu$m down to 50 $\mu$m and less placed on the conductor sides, which show substantially reduced shrinkage and shrinking tendencies.

Advantageous variations and further developments of the method of this invention are described in the claims and this specification.

Also, ribbon cables are produced in accordance with the method proposed by the invention.

Preferably the ribbon-shaped conductors are placed on a first insulating layer and are thereafter placed into contact with the second insulating layer and combined.

Highly temperature-resistant thermoplastic materials are particularly suited as the thermoplastic materials, such as high-strength polyamides, high-strength polyesters, PVC, thermoplastic polyurethanes, polyolefins, polyimides, thermoplastic materials which can be cross-linked, fluorine-containing thermoplastic polymers, linear (semi)aromatic polyesters, linear polyarylene oxides, sulfides and sulfones, ethylene-vinyl acetate copolymers, ethylene-alkyl(meth) acrylate copolymers and terpolymers, wherein these can be used individually or in compatible mixtures, possibly after subsequent cross-linking.

The method in accordance with this invention, using an extrusion coating, or the chill roll method, can be practiced in different ways in accordance with this invention. In accordance with one embodiment of this invention, both surfaces of the ribbon-shaped conductors located on one level have an insulating layer by extrusion coating. In accordance with a further embodiment of this invention, only one of the two insulating layers is created in this manner, while the second insulating layer has a prefabricated thermoplastic film. In this case the prefabricated thermoplastic film can either be an extruded flat film or a film produced by calendering which, however, are in prefabricated form for producing the lamination.

In accordance with this invention, the plastic film forming a first insulating layer is introduced into a gap formed between two rollers, and the conductors guided on one level are introduced into the gap over one of the two rollers forming the gap and are pressed, at least partially, into the plastic film on one side by the pressure exerted by the two rollers. Then the plastic film with the impressed ribbon-shaped conductors is guided to a second gap formed by a further pair of rollers and is pulled through it, and prior to entering the second roller gap, a thermoplastic melt is extruded out of a flat film nozzle onto one of the two rollers of the second roller pair and applied as the second insulating layer. The conductors and the first insulating layer are combined with the plastic melt forming the second insulating layer into the ribbon cable film in the course of passing through the second gap, wherein the ribbon-shaped conductors pressed into the plastic film are used as stabilizing and traction elements for preventing the stretching and/or shrinking of the insulating layers in the longitudinal direction of the conductors.

In a further embodiment of the method in accordance with this invention, the conductors guided on one level are continuously placed on a first insulating layer made of a thermoplastic film conducted over a roller and are moved along with the plastic film. Then, during rotation with the roller or of a following roller a second insulating layer in the form of a thermoplastic melt is continuously applied from a flat film nozzle of an extruder and is combined into a ribbon cable film with the plastic film and the conductors.

In accordance with a further embodiment of this invention, the conductors guided on one level are introduced into a gap formed between two rollers, and a thermoplastic film as a first insulating layer is supplied to the gap via one of the rollers forming the gap. A thermoplastic melt is extruded from a flat film nozzle of an extruder and applied to the other roller upstream of the roller gap for forming the second insulating layer, and while passing through the gap, the conductors are combined with the two insulating layers into a ribbon cable film and drawn off.

In accordance with a further embodiment of this invention, the ribbon cable film can also be produced so that the conductors guided on one level are introduced into a gap formed between two rollers, and upstream of the gap a thermoplastic melt is extruded from each flat film nozzle of each extruder for forming each insulating layer and is applied to each one of the rollers and when passing through the gap, the insulating layers and the conductors are combined into a ribbon cable film and drawn off.

In a further advantageous embodiment of the method in accordance with this invention for producing a shrink-resistant and dimensionally stable ribbon cable film, a first insulating layer having a thermoplastic melt from a flat film nozzle of a first extruder is continuously applied to the first roller and subsequently the conductors, which are guided spaced apart on one level are conducted over a roller which, together with the first roller forms a first gap, and are placed on the first insulating layer present on the first roller, wherein the gap width of the gap formed by the distance of the rollers from each other determines the thickness of the first insulating layer. Then a thermoplastic melt from a flat film nozzle of a second extruder is continuously applied on the first insulating layer still present on the first roller, on which the conductors lie as the second insulating layer. A further roller (9*a*) is assigned downstream of the first roller to form a second roller gap, wherein the distance of the rollers from each other determines the gap width of the second gap and therefore the total thickness of the produced ribbon cable film. After leaving the gap, the ribbon cable film is conducted away from the first roller and is guided, resting on the roller, and is drawn off by the roller, which is assigned to the roller and together with the roller forms the draw-off gap.

The method in accordance with one embodiment of this invention allows the application of the two insulating layers from a plastic melt by the chill roll method, wherein the calibration of the layer thickness occurs in two steps.

The method in accordance with this invention makes it also possible to embody the insulating layers for the surfaces not only in a single layer, but also in two or more layers, wherein during extrusion coating the insulating layer can be directly co-extruded in the desired multi-layered manner. Thus, it is possible to produce an appropriate structure of a ribbon cable with inner embedding layers and outer, highly temperature-resistant layers of the desired quality and in an economical manner.

The method of this invention allows the continuous production of ribbon cables with film widths of 1 m and more, wherein production speeds of 100 m/min and more are possible.

The application in accordance with this invention of the extrusion coating permits the complete embedding of the conductors in insulating materials, wherein the desired adhesive homogeneous bond between two insulating layers produced by extrusion coating, as well as between a prefabricated thermoplastic film and an insulating layer produced by extrusion coating, is created without problems. Depending on the requirements, it is possible to produce ribbon cables with the desired number of conductors in the desired widths, wherein the possible production width of ribbon cable films allows the parallel production of several ribbon cables in one film, which are then divided by cutting them parallel with the conductors into an appropriate number of ribbon cables of the desired design.

This invention permits the production of ribbon cables of very small total thicknesses, down to 100 $\mu$m.

The method in accordance with this invention makes it possible to produce a multitude of ribbon cables which are differently equipped with respect to the number of conductors, the conductor cross sections and the insulating layers.

Should coupling agents be desired, materials which can be thermoplastically worked, such as ethylene, copolymers such as ethylene-vinyl acetate copolymers, copolymers and terpolymers with acryl comonomers, such as ethylene-butyl acrylate copolymers, ethylene-acrylic acid copolymers, styrene polymers, polyester melt adhesives, acrylates and methacrylates, are considered here. Thermoplastic coupling agents are preferred, which can also be applied by extrusion coating. In accordance with this invention, it is possible to co-extrude two-layer or multi-layer insulating layers, having a thermoplastic layer as the outer layer and a coating of a coupling agent facing the conductors.

BRIEF DESCRIPTION OF THE DRAWINGS

This invention is explained in greater detail in view of exemplary embodiments represented in the drawings, wherein:

FIG. 1 is a schematic representation of the production process for ribbon cables in accordance with a chill roll method;

FIG. 2 is a schematic plan view on the ribbon cable film in the direction C as shown in FIG. 1;

FIG. 3 is a schematic cross section taken through the ribbon cable film along the section line AA shown in FIG. 2;

DESCRIPTION OF PREFERRED EMBODIMENTS

Figure 4:
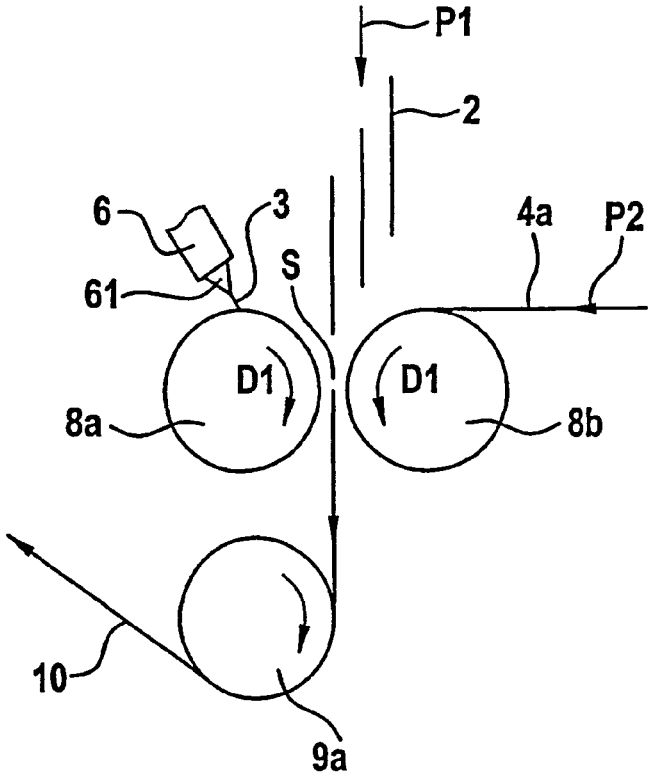
FIG. 4 is a schematic representation for the production of a ribbon cable film in combination with the roll chill method and plastic film.

The method for producing ribbon cables by two insulating layers produced in situ by extrusion coating from a thermoplastic melt is schematically represented in FIG. 1. Ribbon-shaped electrical conductors 2, for example with a very flat rectangular cross section made of copper, for example, are drawn off rolls, not represented, arrive in the direction of the arrow P1 and are conducted on a level in which they extend, spaced apart from each other and parallel, wherein the arrangement of the conductors 2 is determined by the desired embodiment of the ribbon cables to be produced. The conductors 2 are guided to a roller gap S, formed by the rollers 8*a*, 8*b*. An extruder 6 with a flat film nozzle/ribbon film nozzle 61, or 7, 71, is assigned to each roller 8*a* or 8*b* upstream of the roller gap S, from which the thermoplastic melt 3 or 4 exits and is guided onto the roller surface 8*a* or 8*b*. The rollers 8*a* or 8*b* have a higher speed in the arrow direction D1 than the extrusion speed of the melts 3, 4, so that the plastic melt is drawn out in accordance with the speed difference and is brought at the desired thickness on the insulating layers. The plastic melts 3, 4 are brought together with the conductors 2 in the roller gap S and the conductors 2 are embedded in the insulating layers formed by the plastic melts 3, 4, as shown in FIG. 3. A homogeneous insulation is created when forming the insulating layers 3, 4 from the same material. The width of the ribbon cable films 10 formed is determined by the roller width and the nozzle width and can be 1 m or more. As shown in the view from above in FIG. 2, a plurality of electrical conductors 2, for example copper strips, can be embedded at the desired distances parallel with each other in the thermoplastic melts, and thus a plurality of ribbon cables 1.1, 1.2, 1.3 of the desired structure can be simultaneously created by cutting the ribbon cable film 10 parallel with the conductors 2 in accordance with the separating cuts 5.

A further embodiment for producing ribbon cable films is shown in FIG. 4, wherein a roller gap S is formed between two rollers 8*a*, 8*b*, into which the conductors 2, which are guided on one level spaced apart and parallel to each other enter, for example vertically, in the arrow direction P1. A thermoplastic film 4*a*, prefabricated by calendering or extrusion, for example, is supplied to the roller gap S in the arrow direction P2 over one of the rollers 8*b*. Upstream of the roller gap S, a thermoplastic melt 3 is also applied to the roller surface 8*a*, as described already in FIG. 1, by the extruder 6 and the flat film nozzle 61 via the other roller 8*a* and is drawn out to the desired film and film thickness in accordance with the so-called chill roll method. The prefabricated plastic film 4*a*, the conductors 2 and the plastic melt placed on the roller 8*a* by extrusion coating are brought together in the roller gap S and combined into the ribbon cable film 10. Additional cooling rollers and draw-off roller, as well as smoothing arrangements, can be placed downstream of the roller gap formed by the rollers 8*a*, 8*b*. The arrangement for producing the ribbon cable film 10 by extrusion coating in accordance with the chill roll method, schematically shown in FIG. 1, can also be supplemented by an appropriate additional arrangement of downstream located cooling rollers, deflection rollers, smoothing rollers, etc.

It is possible to subsequently temper the ribbon cable film produced in this way, in order to reduce a shrinking tendency.

Figure 5:
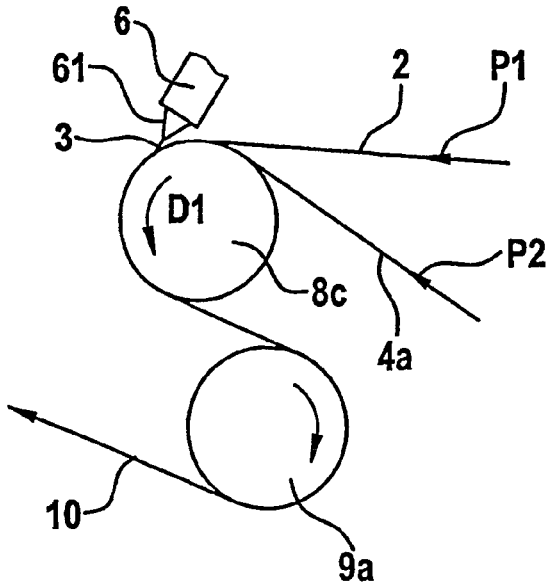
FIG. 5 is a further embodiment of the combination of the extrusion coating and plastic film for producing a ribbon cable film.

Instead of forming a roller gap, it is also possible, as shown by way of example and schematically in FIG. 5, to supply an insulating layer in the form of a plastic film 4*a* via a roller 8*c* to an imagined roller gap, see arrow P2, and to place the conductors 2, see arrow P1, which are conducted parallel on one level spaced apart, on this plastic film 4*a*. Then the still free surface of the conductors can be covered by an extruded layer 3, produced by an extruder 6 and a flat film nozzle 61, and the extruded layer 3, the conductors 2 and the plastic film 4*a* can be combined under continued guidance over a roller 9*a* into the ribbon cable film 10 and drawn off.

Figure 6:
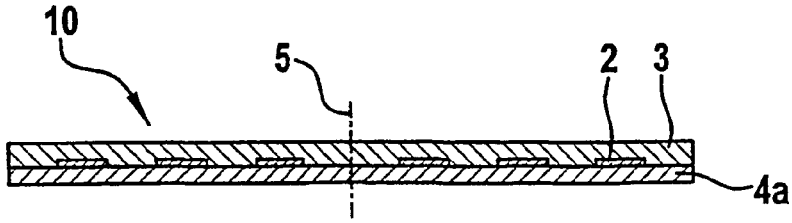
FIG. 6 is a cross section taken through a ribbon cable film produced in accordance with the method of FIG. 4 or 5.

In accordance with the production method in FIGS. 4 and 5 with the use of a prefabricated plastic film, a ribbon cable film 10 is created, wherein the conductors 2 rest on the prefabricated film 4*a* as the first insulating layer, and the plastic melt applied by extrusion coating covers the conductors 2 as the second insulating layer 3 and, as shown in FIG. 6, is connected with the first insulating layer 4*a*. The ribbon cable film 10 can also have any arbitrary arrangement of conductors 2 within the insulating layers 3, 4*a*, and can be divided into individual ribbon cables by appropriate separating cuts 5.

The method in accordance with this invention allows high production speeds, minimum thicknesses of the insulating layers and exact placement and embedding of the conductors.

Figure 7:
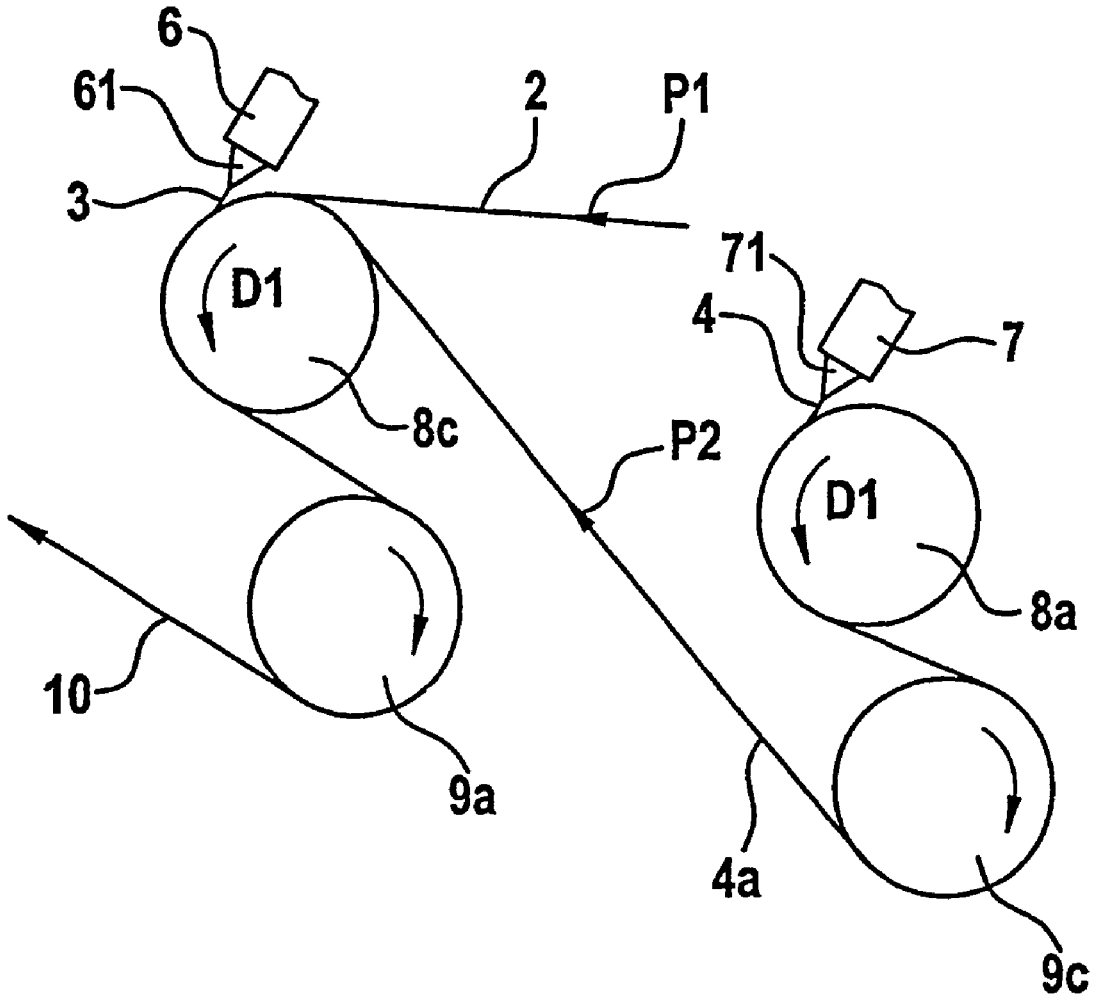
FIG. 7 is a further embodiment for producing a ribbon cable film employing the extrusion coating.

FIG. 7 is an example of how it is possible, for example in combination with the method represented in FIG. 5, to produce the plastic film 4*a*, for example in an upstream located chill roll arrangement, as a ribbon film by extrusion coating by means of a roller 8*a*, and can be fed via a draw-off roller 9*c* in the arrow direction P2 for further coating.

According to this invention, thermoplastic materials for the insulating layers, or the insulating layers resting against the electrical conductors, in particular copper conductors, should have no connection, if possible, with the electrical conductor, in particular the copper, so that the connecting points of the contacts are immediately clean when the insulation is removed, and do not require further processing.

Figure 8:
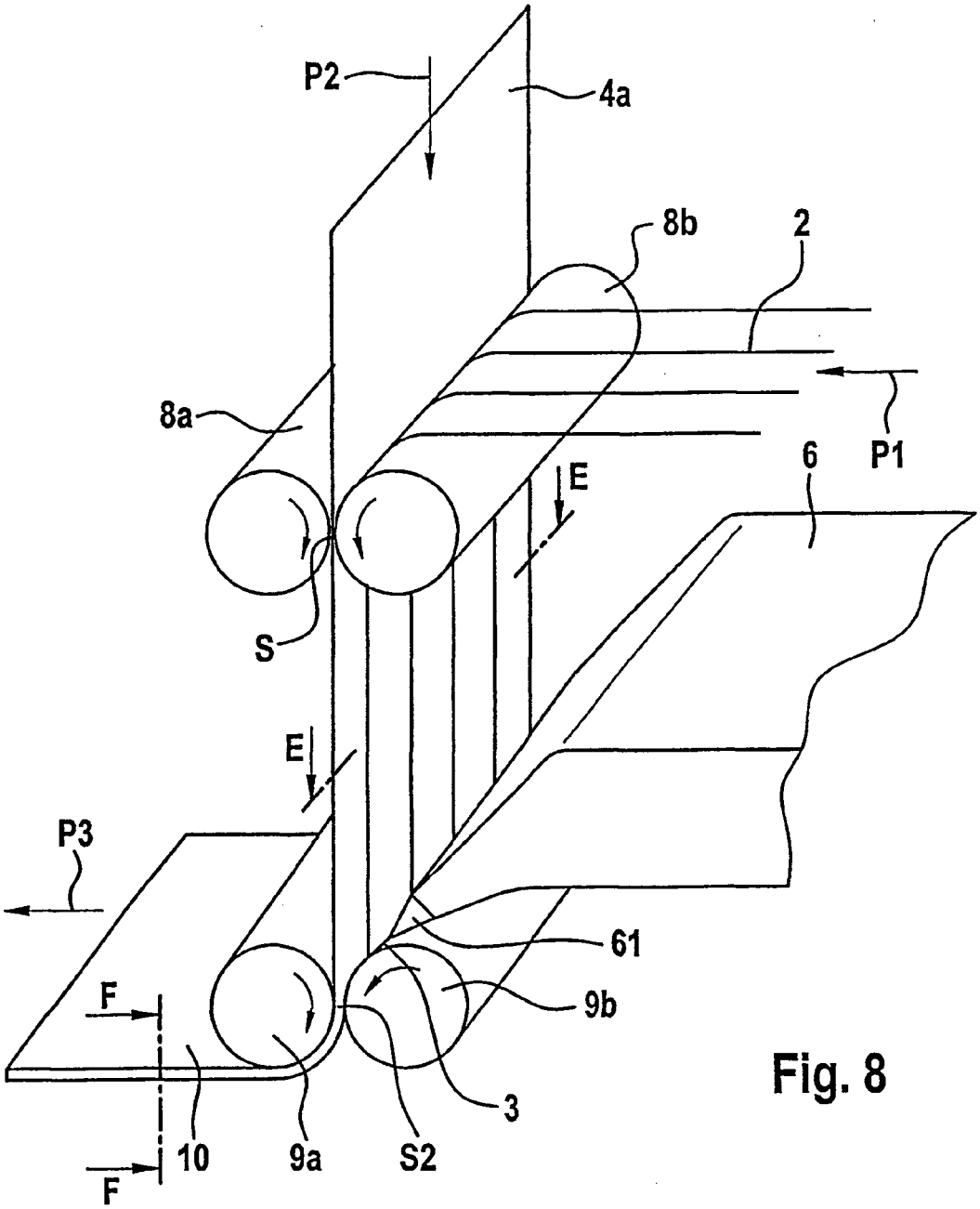
FIG. 8 is a schematic representation of a variation for producing a ribbon cable film with plastic film and extrusion coating.
Figure 9:
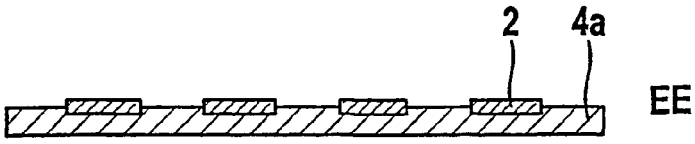
FIG. 9 is a cross section taken alone line EE from FIG. 8.
Figure 10:
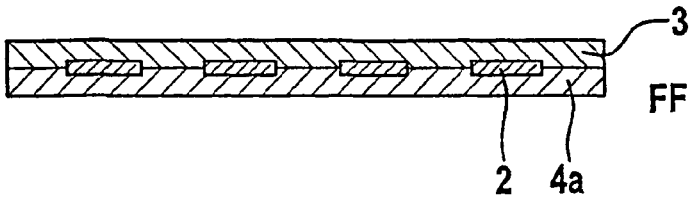
FIG. 10 is a cross section taken along line FF from FIG. 9.

An installation for the production of a particularly low shrinkage ribbon cable film 10 is schematically shown in FIG. 8. The first roller gap S is formed between the roller pair 8*a*, 8*b*. A prefabricated plastic film 4*a*, which forms an insulating layer, is vertically drawn through the gap S in the arrow direction P2. Simultaneously, the very flat copper ribbons 2 are conducted in the arrow direction P1 over the roller surface of the roller 8*b* to the gap 5 and, while passing through it, are pressed under pressure, the roller 8*a* operates as a pressure roller, into the surface of the plastic film 4*a*. Thus a pre-composite is created, approximately as represented in FIG. 9. The copper ribbons are used as supports, in the manner of a woven textile, in the longitudinal extension of the plastic materials and counteract stretching, as well as shrinking, of the plastic film. Subsequently the pre-composite 4*a*, 2 passes through a further roller gap S2, formed by the roller pair 9*a*, 9*b*. During this a thermoplastic melt is directly extruded on the roller surface of the roller 9*b* by means of a flat film nozzle 61 of an extruder 6, and the insulating layer 3 extruded in this way is fed to the gap S2, so that it is combined in the gap S2 with the plastic film 4*a* on the side to which the copper ribbons are attached. A sufficient pressure is exerted in the gap S2. The composite thus produced as the ribbon cable 10 with outer insulating layers 4*a*, 3 and conductors 2 in the interior is then drawn off in the arrow direction P3. A low-tension composite is produced by this method, whose cross section can be schematically seen in FIG. 10.

Figure 11:
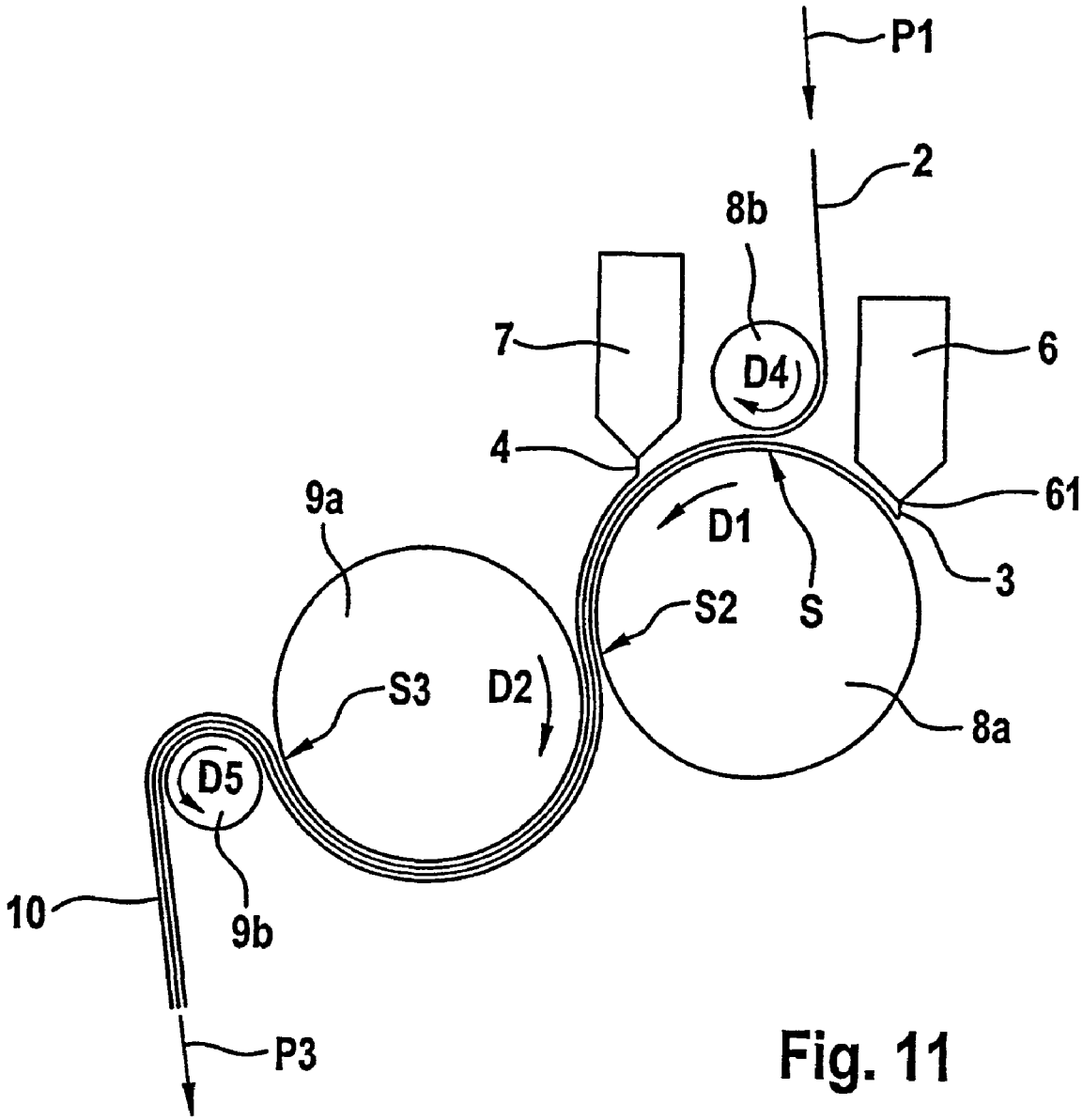
FIG. 11 is a schematic representation of a variation for producing a ribbon cable film in accordance with the chill roll method by a chill roll unit.

A further method variation is shown in FIG. 11, which makes it possible to apply the two insulating layers made of a plastic melt by means of a chill roll unit. A first roller 8*a* is provided for this purpose, which rotates in the arrow direction D1. A thermoplastic melt is applied to this roller by means of the extruder 6 via the flat film nozzle 61 as the first insulating layer 3. At some distance from the place of application, a second roller 8*b* is assigned to the roller 8*a*, forming the roller gap S. The ribbon-shaped conductors 2, which are guided on one level spaced apart from each other, are fed in the arrow direction P1 via the roller 8*b* to the roller gap and are combined with the insulating layer 3 during the passage through the roller gap S. The roller 8*b*, over which the conductors 2 are fed and deflected, rotates in the arrow direction D4. The required gap width is the result of the defined distance between the rollers 8*a* and 8*b*, and therefore also the desired thickness of the insulating layer 3.

Downstream of the combining point of the ribbon-shaped conductors 2 with the first insulating layer 3 in the roller gap S, a further extruder 7 with a flat film nozzle 71 is assigned to the roller 8*a*, by which the second insulating layer 4 in the form of a thermoplastic melt is applied to the first insulating layer with the conductors 2 placed on it. Downstream of this application point a further roller 9*a* is assigned to the roller 8*a* and forms a second roller gap S2 with it, through which the insulating layers 3, 4 with the ribbon-shaped conductor 2 placed between them are passed, are combined with each other by the application of pressure, and are calibrated. The distance of the rollers 8*a* and 9*a* from each other limits the total thickness of the ribbon cable film 10 produced from the plastic melts of the insulating layers 3 and 4, as well as the ribbon-shaped conductors 2. The roller 9*a* is rotated in the arrow direction D2. The roller 9*b*, which rotates in the arrow direction D5, is assigned to the roller 9*a* at an appropriate distance from the roller gap S2 between the rollers 9*a* and 8*a* as a draw-off roller and for forming the roller gap S3. The roller 9*b* can also be embodied as a pressure roller. The ribbon cable film 10 is then drawn off in the arrow direction P3 and can then be divided into appropriate individual ribbon cables in accordance with the arrangement and allocation of the conductors 2 on the inside by longitudinal separation.

What is claimed is:

1. In a method for continuous production of ribbon cables (1.1, 1.2, 1.3) with electrical conductors which are spaced apart from each other and parallel with respect to each other and are embedded in insulating material, wherein ribbon-shaped conductors (2) are guided, spaced apart from and level with each other, forming two surfaces having insulating layers (3 or 4) of thermoplastic materials, and the ribbon-shaped conductors are embedded between the insulating layers, the improvement comprising: at least a first layer of the insulating layers (3, 4) made of a molten thermoplastic material produced by a flat film nozzle (61, 71) of an extruder (6, 7) and immediately connected in a still plasticized state with the ribbon-shaped conductors (2) and a second of the insulating layers (4 or 3) under an application of pressure.

2. In the method in accordance with claim 1, wherein one of the insulating layers forming the surfaces is employed in a form of a pre-fabricated plastic film (4*a*), and is connected with the plastic melt of the second insulating layer (3).

3. In the method in accordance with claim 2, wherein the ribbon-shaped conductors (2) are placed on the first insulating layer of the insulating layers (3, 4) and then are combined with the second insulating layer.

4. In the method in accordance with claim 3, wherein the plastic film (4*a*) forming the first insulating layer is introduced into a gap (S) formed between two rollers (8*b*, 8*a*), and the conductors (2) guided on the one level are introduced into the gap (S) over a first roller (8*b*) of the two rollers (8*a*, 8*b*) forming the gap (S) and are pressed, at least partially, into the plastic film on one side by pressure exerted by the two rollers, and thereafter the plastic film (4*a*) with the impressed ribbon-shaped conductors (2) is guided to and pulled through a second gap (S2) formed by a second roller pair (9*a*, 9*b*), and prior to entering the second roller gap (S2), a thermoplastic melt is extruded out of a flat film nozzle (61) onto one of the two rollers of the second roller pair (9*a*, 9*b*) and applied as a second insulating layer (3), and the conductors (2) and the first insulating layer (4*a*) are combined with the plastic melt forming the second insulating layer into the ribbon cable film (10) while passing through the second gap (S2), wherein the ribbon-shaped conductors (2) pressed into the plastic film act as stabilizing and traction elements for preventing at least one of stretching and shrinking of the insulating layers in a longitudinal direction of the conductors.

5. In the method in accordance with claim 1, wherein the conductors (2) are introduced into a gap (S) formed between two rollers (8*a*, 8*b*), and upstream of the gap (S) a first thermoplastic melt is extruded from a first flat film nozzle (61, 71) of a first extruder (6, 7) and a second thermoplastic melt is extruded from a second flat film nozzle (61, 71) of a second extruder (6, 7), each of the first and second thermoplastic melts being applied to one of the two rollers (8*a*, 8*b*) for forming one of the insulating layers (3, 4), and while through the gap (S), the insulating layers (3, 4) and the conductors (2) are combined into a ribbon cable film (10) and drawn off.

6. In the method in accordance with claim 2, wherein the conductors (2) are continuously placed on a first insulating layer made of a thermoplastic film (4*a*) conducted over a roller (8*c*) and are moved along with the plastic film, and then during one of rotation with the roller (8*c*) and a second roller a second insulating layer (3) in a form of a thermoplastic melt is continuously applied from a flat film nozzle (61) of an extruder (6) and is combined into a ribbon cable film (10) with the plastic film (4*a*) and the conductors (2).

7. In the method in accordance with claim 2, wherein the conductors (2) are introduced into a gap (S) formed between two rollers (8*a*, 8*b*), and a thermoplastic film (4*a*) as the first insulating layer is supplied to the gap (S) by a first roller of the rollers (8*b*) forming the gap (S), and a thermoplastic melt is extruded from a flat film nozzle (61) of an extruder (6) and applied to a second roller (8*a*) of the rollers upstream of the roller gap (S) for forming the second insulating layer (3), and while passing through the gap (S) the conductors (2) are combined with the two insulating layers into a ribbon cable film (10) and drawn off.

8. In the method in accordance with claim 1, wherein a first insulating layer (3) being of a thermoplastic melt from a flat film nozzle (61) of a first extruder (6) is continuously applied to a first roller (8*a*) and subsequently the conductors (2) are conducted over a second roller (8*b*) which, together with the first roller (8*a*) forms a first gap (S), and are placed on the first insulating layer (3) present on the first roller (8*a*), wherein a gap width of the gap (S) formed by the distance of the rollers (8*a*, 8*b*) from each other determines a thickness of the first insulating layer (3), after which a thermoplastic melt from a flat film nozzle (71) of a second extruder (7) is continuously applied on the first insulating layer (3) present on the first roller (8*a*) on which the conductors (2) lie, as the second insulating layer (4), and a second roller (9*a*) is assigned downstream of the first roller (8*a*) to form a second roller gap (S2), wherein a distance of the rollers (8*a* and 9*a*) from each other determines a second gap width of the second gap (S) and a total thickness of the produced ribbon cable film (10), and after leaving the gap (S2) the ribbon cable film (10) is conducted away from the first roller (8*a*) and is guided, resting on the roller (9*a*), and is drawn off by the roller (9*b*), which is assigned to the roller (9*a*) and together with the roller (9*a*) forms a draw-off gap (S3).

9. In the method in accordance with claim 8, wherein the insulating layers (3, 4, or 4*a*) are constructed of one of a single-layer, a double-layer and multi-layers.

10. In the method in accordance with claim 9, wherein one of two-layer and multi-layer insulating layers (3, 4, or 4*a*), having a thermoplastic layer as an outer layer and a coating of a coupling agent facing the conductors (2) are co-extruded by flat film nozzles (61, 71) of the extruders (6, 7).

11. In the method in accordance with claim 10, wherein the thermoplastic layer comprises a thermoplastic material selected from a group consisting of polyamide, PVC, thermoplastic polyurethane, polyolefins, high-strength polyesters, polyimides, thermoplastic materials which can be cross-linked, fluorine-containing thermoplastic polymers, linear (semi)aromatic polyesters, linear polyarylene oxides, sulfides and sulfones, ethylene-vinyl acetate copolymers, ethylene-alkyl(meth)acrylate copolymers and ter-polymers.

12. In the method in accordance with claim 11, wherein the coupling agent is selected from a group consisting of ethylene copolymers, including EVA, and their copolymers, styrene polymers, polyester melt adhesives, acrylates and methacrylates.

13. In the method in accordance with claim 12, wherein the ribbon cable film (10) is cut parallel with the longitudinal extension of the conductors to form two or more ribbon cables (1.1, 1.2, 1.3).

14. In the method in accordance with claim 13, wherein the insulating layers (3, 4) which are produced by extrusion and applied to the rollers by extrusion coating by flat film nozzles have a thickness of 50 to 100 $\mu$m.

15. In the method in accordance with claim 1, wherein the ribbon-shaped conductors (2) are placed on the first insulating layer of the insulating layers (3, 4) and then are combined with the second insulating layer.

16. In the method in accordance with claim 1, wherein a plastic film (4*a*) forming the first insulating layer is introduced into a gap (S) formed between two rollers (8*b*, 8*a*), and the conductors (2) are introduced into the gap (S) over a first roller (8*b*) of the two rollers (8*a*, 8*b*) forming the gap (S) and are pressed, at least partially, into the plastic film on one side by pressure exerted by the two rollers, and thereafter the plastic film (4*a*) with the impressed ribbon-shaped conductors (2) is guided to and pulled through a second gap (S2) formed by a second roller pair (9*a*, 9*b*), and prior to entering the second roller gap (S2), a thermoplastic melt is extruded out of a flat film nozzle (61) onto one of the two rollers of the second roller pair (9*a*, 9*b*) and applied as a second insulating layer (3), and the conductors (2) and the first insulating layer (4*a*) are combined with the plastic melt forming the second insulating layer into a ribbon cable film (10) while passing through the second gap (S2), wherein the ribbon-shaped conductors (2) pressed into the plastic film act as stabilizing and traction elements for preventing at least one of stretching and shrinking of the insulating layers in a longitudinal direction of the conductors.

17. In the method in accordance with claim 1, wherein the conductors (2) are continuously placed on a first insulating layer made of a thermoplastic film (4*a*) conducted over a roller (8*c*) and are moved along with the plastic film, and then during one of rotation with the roller (8*c*) and a second roller a second insulating layer (3) in a form of a thermoplastic melt is continuously applied from a flat film nozzle (61) of an extruder (6) and is combined into a ribbon cable film (10) with the plastic film (4*a*) and the conductors (2).

18. In the method in accordance with claim 1, wherein the conductors (2) are introduced into a gap (S) formed between two rollers (8*a*, 8*b*), and a thermoplastic film (4*a*) as the first insulating layer is supplied to the gap (S) by a first roller of the rollers (8*b*) forming the gap (S), and a thermoplastic melt is extruded from a flat film nozzle (61) of an extruder (6) and applied to a second roller (8*a*) of the rollers upstream of the roller gap (S) for forming the second insulating layer (3), and while passing through the gap (S) the conductors (2) are combined with the two insulating layers into a ribbon cable film (10) and drawn off.

19. In the method in accordance with claim 1, wherein the insulating layers (3, 4, or 4*a*) are constructed of one of a single-layer, a double-layer and multi-layers.

20. In the method in accordance with claim 1, wherein one of two-layer and multi-layer insulating layers (3, 4, or 4*a*), having a thermoplastic layer as an outer layer and a coating of a coupling agent facing the conductors (2) are co-extruded by flat film nozzles (61, 71) of the extruder (6, 7).

21. In the method in accordance with claim 1, wherein the thermoplastic material is selected from a group consisting of polyamide, PVC, thermoplastic polyurethane, polyolefins, high-strength polyesters, polyimides, thermoplastic materials which can be cross-linked, fluorine-containing thermoplastic polymers, linear (semi)aromatic polyesters, linear polyarylene oxides, sulfides and sulfones, ethylene-vinyl acetate copolymers, ethylene-alkyl(meth)acrylate copolymers and ter-polymers.

22. In the method in accordance with claim 20, wherein the coupling agent is selected from a group consisting of ethylene copolymers, including EVA, and their copolymers, styrene polymers, polyester melt adhesives, acrylates and methacrylates.

23. In the method in accordance with claim 1, wherein the ribbon cable film (10) is cut parallel with the longitudinal extension of the conductors to form two or more ribbon cables (1.1, 1.2, 1.3).

24. In the method in accordance with claim 1, wherein the insulating layers (3, 4) which are produced by extrusion and applied to the rollers by extrusion coating by flat film nozzles have a thickness of 50 to 100 $\mu$m.

* * * * *